US008544925B2

(12) United States Patent
Franke

(10) Patent No.: US 8,544,925 B2
(45) Date of Patent: Oct. 1, 2013

(54) SLING ELEMENT AND COMBINATION CONSISTING OF A SLING ELEMENT AND A FASTENING MEANS

(75) Inventor: Boris Franke, Heinsberg (DE)

(73) Assignee: SpanSet-secutex GmbH, Geilenkirchen (DE)

( * ) Notice: Subject to any disclaimer, the term of this patent is extended or adjusted under 35 U.S.C. 154(b) by 98 days.

(21) Appl. No.: 13/145,404

(22) PCT Filed: Mar. 12, 2010

(86) PCT No.: PCT/EP2010/053176

§ 371 (c)(1),
(2), (4) Date: Sep. 15, 2011

(87) PCT Pub. No.: WO2010/105978

PCT Pub. Date: Sep. 23, 2010

(65) Prior Publication Data

US 2011/0316297 A1 Dec. 29, 2011

(30) Foreign Application Priority Data

Mar. 17, 2009 (DE) ..... 10 2009 013 197

(51) Int. Cl.
*B66C 1/66* (2006.01)

(52) U.S. Cl.
USPC ..... 294/215; 294/74; 411/354

(58) Field of Classification Search
USPC ..... 294/215, 74, 82.1; 411/354, 538
See application file for complete search history.

(56) References Cited

U.S. PATENT DOCUMENTS

| | | | | | |
|---|---|---|---|---|---|
| 1,462,435 | A | * | 7/1923 | West | 294/215 |
| 1,535,022 | A | * | 4/1925 | Jenkins | 294/81.3 |
| 1,694,326 | A | * | 12/1928 | Klausner | 411/396 |
| 2,848,267 | A | | 8/1958 | Wroblewski | |
| 4,118,059 | A | * | 10/1978 | Lindsay | 294/74 |
| 5,141,357 | A | * | 8/1992 | Sherman et al. | 403/408.1 |
| 5,823,588 | A | * | 10/1998 | Morghen | 294/89 |
| 6,039,500 | A | * | 3/2000 | Kwon | 403/78 |
| 2009/0107062 | A1 | * | 4/2009 | Pedersen | 52/223.13 |

FOREIGN PATENT DOCUMENTS

| | | | |
|---|---|---|---|
| JP | 2002147340 | A | 5/2002 |
| WO | 2008000262 | A1 | 1/2008 |

* cited by examiner

*Primary Examiner* — Dean Kramer
(74) *Attorney, Agent, or Firm* — The Webb Law Firm

(57) ABSTRACT

A sling element and a combination for coupling sling gear, to a goods item to be transported, wherein the sling element has a fastening section, into which an oblong-shaped opening is formed which leads from the upper side of the fastening section to a contact area formed on the underside of the fastening section. The combination enables the sling element to be fastened in a durably secure way even with adverse loads. This is achieved by a wedge area aligned in the longitudinal direction of the opening of the fastening section being formed on the fastening section, which wedge area runs in a plane which intersects the longitudinal axis of the opening at an acute angle and is designed as a support for a fastening member which is provided to brace the sling element on the goods item to be transported.

17 Claims, 3 Drawing Sheets

SLING ELEMENT AND COMBINATION CONSISTING OF A SLING ELEMENT AND A FASTENING MEANS

BACKGROUND OF THE INVENTION

1. Field of the Invention

The invention relates to a sling element for coupling sling gear, such as a shackle, hook or ring, or a lifting means, such as a belt, a rope, a chain or a strap, to a goods item to be transported, wherein the sling element has a fastening section into which an oblong-shaped opening is formed which leads from the upper side of the fastening section to a contact area formed on the underside of the fastening section. The invention also relates to a combination consisting of a sling element of that kind and a fastening means, wherein the fastening means can comprise a tensioning element and an adapter piece.

2. Description of Related Art

Sling elements of the kind in question here usually have a fastening section, with which they can be directly fastened to the goods item to be transported, and a sling element, to which the respective lifting means, such as a belt, rope, chain or strap, by means of knots or loops can be either directly connected or, due to practical and safety-related considerations, can be connected via sling gear serving as an intermediate element, such as a shackle, a hook or ring. At the same time, openings are formed into the fastening sections, through which a fastening means, which is typically a screw or a bolt, can be guided into a corresponding opening on the respective flange of the goods item to be transported. In order to make mounting and alignment of the sling element easier, the openings concerned are generally formed as elongated holes, so that the exact angular position of the respective sling element can be adjusted again before final bracing of the respective fastening element.

Such sling gear is, for example, used for lifting and aligning tall steel, separately prefabricated tower elements of wind power plants or comparably sized pipes of pipelines or the like. The diameter of such, in each case tubular, elements is generally considerably less than their length. The elements are therefore transported to the respective site lying flat.

In the case of tower elements, they then at the site not only have to lifted from the heavy transporter, wagon or ship used to transport them and swung into their final position, but they also, additionally, have to be turned from a horizontal alignment into a vertical alignment, so that they can be placed onto a base or a tower element which has already been erected.

For lifting and aligning, typically in each case at least two sling elements are fastened to the face sides of the end flanges of the tubular elements, so that the one sling element is mounted, for example, at 10 o'clock and the second element at 2 o'clock.

As a result of this arrangement, the line of effect of the lifting forces, which act on the fastening means used to fasten the respective sling element when lifting the goods item to be conveyed, is aligned at an acute angle to the effect of gravity. Due to the fact that the fastening means in each case sits in an oblong opening of the assigned fastening section of the sling element, in the event that the respective tensioning means is not tightened with sufficient force, the sling element can, therefore, slip under the load. After overcoming the friction prevailing between the sling element and the respective flange, this slipping occurs abruptly many times, so that a dangerous, sudden overloading of the fastening means by lateral forces can occur, for which the fastening means is not designed.

SUMMARY OF THE INVENTION

Against this background, the object of the invention was to create a sling element, in which the risk of slipping is minimised even with deficient tension of the respective fastening means. Moreover, an assembly comprising such a sling element and a fastening element should be proposed, with which the sling element can be fastened in a durably secure way even with adverse loads.

A sling element according to the invention has, in a way which is known per se, at least one fastening section, into which an oblong-shaped opening is formed which leads from the upper side of the fastening section to a contact area formed on the underside of the fastening section.

According to the invention, a wedge area aligned in the longitudinal direction of the oblong opening of the fastening section is now formed on the fastening section. This wedge area runs in a plane which intersects the longitudinal axis of the opening at an acute angle. The wedge area is designed as a support for a fastening means which is provided to brace the sling element on the goods item to be transported.

The wedge area provided on the fastening section of the sling element according to the invention is consequently aligned, so that the forces acting in the longitudinal direction of the opening of the fastening section, and hence transverse to the respective fastening means, are diverted in the direction of the tensioning forces exerted by the fastening means, and so additionally contribute to holding the sling element on the goods item to be transported in each case. In this way, the sling element is wedged, whereby slipping of the sling element is reliably prevented.

Correspondingly, in a combination according to the invention consisting of a sling element designed according to the invention and a fastening means for bracing the sling element on a goods item to be transported, the fastening means comprises a shaped element with a wedge area, with which the fastening means is movably supported on a wedge area of the fastening section, assigned to it, of the sling element.

The shaped element provided with the wedge area can, for example, be a separately formed shoulder of a tensioning element serving as a fastening means which is formed as one piece, like a screw or a bolt, the shoulder sticking out sufficiently far from the screw shaft. The shaped element provided with the wedge area can equally be the screw head of such a fastening means.

An embodiment of the invention which is particularly versatile and which, at the same time, can be handled easily and securely, however then results if the fastening means comprises a tensioning element, such as a screw or a bolt, and a separately prefabricated adapter piece as the shaped element provided with the wedge area, the adapter piece having a supporting area for supporting the tensioning element, as well as a through-opening, through which the tensioning element can be guided into the opening of the assigned fastening section.

The formation of adverse lateral forces acting on the respective fastening means can be prevented, according to a first embodiment of the invention, by a wedge area in each case extending with the same angular alignment with respect to the longitudinal axis of the oblong opening of the fastening section along both sides of the opening. Optimum loads for the fastening means with, at the same time, minimised required space for the respective fastening section of the sling element can be obtained by the respective wedge area adjoining to the oblong opening of the fastening section.

The wedge area formed according to the invention in each case on the fastening section of the sling element is, of course, in each case aligned, in such a way that the wedging, provided according to the invention, of the sling element on the respective fastening means is achieved. That is to say, the effective wedge area in each case is aligned, so that in consequence of a possible movement of the sling element, caused by the respective holding forces, the fastening means is loaded and not relieved of the load in the direction of the tensioning force exerted by it.

In order to simplify the mounting of a sling element according to the invention with regard to the correct alignment of the wedge area in such a manner, a further embodiment of the invention makes provision for at least one pair of wedge areas to be present, of which the plane of the one wedge area is aligned running in the opposite direction to the plane of the other wedge area at an acute angle related to the longitudinal axis of the opening. In this way, a wedge area is always available, regardless of the respective arrangement of the sling element on the fastening section, via which under the effect of the proportion of the lifting forces aligned in each case along the opening of the fastening section, the sling element is braced against the respective fastening means. With regard to the uniform loading of the fastening section, it can also in this connection prove advantageous in this connection if in each case a pair of wedge areas aligned running in opposite directions extends along each of the longitudinal sides of the opening. In order to obtain the same wedge effect, regardless of the respective alignment of the wedge areas of each wedge pair, it is beneficial if the planes of the wedge areas of the respective pair of wedge areas intersect the longitudinal axis of the opening at the same angle in relation to the size.

If two pairs of wedge areas in each case running in opposite directions are provided for each fastening section, then uniform loading of the respective fastening means can be supported by the wedge areas assigned to the respective longitudinal edge of the opening of the fastening section running inclined in the same direction. In this case, the wedge areas present on the respective fastening section and inclined in the same direction are in each case arranged mirror-symmetrically to the longitudinal axis of the opening of the fastening section.

In the event that, with a combination according to the invention consisting of sling element and fastening means, the fastening means has an adapter piece and two pairs of wedge areas, running in opposite directions, are present on the fastening section of the sling element, the support of the tensioning means on the wedge areas of the fastening section can be particularly well ensured by the adapter piece having at least two projecting parts, on which in each case a wedge area is formed which in each case is assigned to one of the wedge areas of the fastening section inclined in the same direction. The adapter piece is, thus, in this case always supported on two identically inclined wedge areas of the fastening section. Should the two wedge areas be used, which in each case are inclined in the other direction, then a correspondingly adapted second adapter piece can be used for this purpose.

Alternatively, the adapter piece can also be designed, so that it is supported on the wedge areas directed in the one or other direction by turning it about its longitudinal axis. In the event that the wedge areas of the fastening section directed in the same direction are arranged mirror-symmetrically to the longitudinal axis of its opening, the adapter piece can, for this purpose, have a pair of wedge areas which are arranged correspondingly distantly from the longitudinal sides of the opening of the assigned fastening section, and a pair of wedge areas, arranged between the first pair, which are arranged adjacent to the longitudinal edges of the opening of the fastening section and transverse to the wedge areas of the first pair of wedge areas. The free movability of the adapter piece can thereby be ensured by the length of the second pair of wedge areas being dimensioned in such a way that the wedge areas of this pair with an alignment transverse to the longitudinal axis of the opening of the fastening section can be moved with clearance through the opening along its longitudinal axis. In this way, by means of an adapter piece or a correspondingly designed fastening means formed in one piece, the respective fastening situation can be adapted to without changing the fastening means. Lateral forces acting on the tensioning element of the fastening means can thereby be minimised to the greatest possible extent.

As an alternative to a mirror-symmetrical arrangement, the wedge areas of the wedge area pairs of the fastening section can also be arranged on the sling element, so that the wedge areas assigned to the respective longitudinal edge run inclined in the opposite direction. With respect to the combination according to the invention, the advantage of this embodiment is that the adapter can be adapted to the respective mounting situation by simply turning it by 180° about the longitudinal axis of the tensioning means, if an oblong opening allowing the required offset is formed into the adapter or, with a fastening means formed as one piece, the shoulder provided with the wedge areas is arranged sufficiently off-centre in relation to the longitudinal axis of the tensioning means.

A particularly simple design, which at the same time has a particularly reliable function, is produced if the opening of the fastening section is formed as an elongated hole with longitudinal sides running parallel to one another. With this embodiment, the wedge areas seen in top view can also have a linear progression, so that the respective fastening means can be easily moved on them.

BRIEF DESCRIPTION OF THE DRAWINGS

The invention is explained below with the help of a drawing illustrating an exemplary embodiment. Shown schematically in each case are.

DETAILED DESCRIPTION OF THE INVENTION

The sling element 1 formed as one piece, for example produced as a forged part, has a semicircular sling section 2, on the ends of which in each case a fastening section 3, 4 sticking out in the radial direction from the sling section 2 and essentially cuboid in shape is integrally formed.

Figure 2:
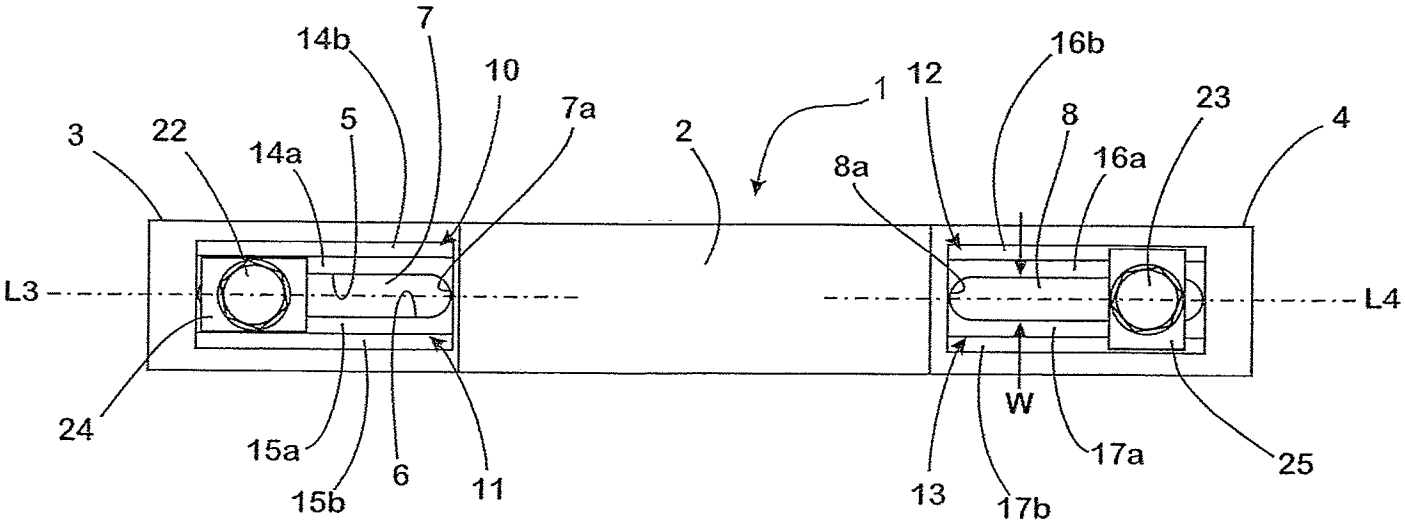
FIG. 2 a sling element in top view.
Figure 4:
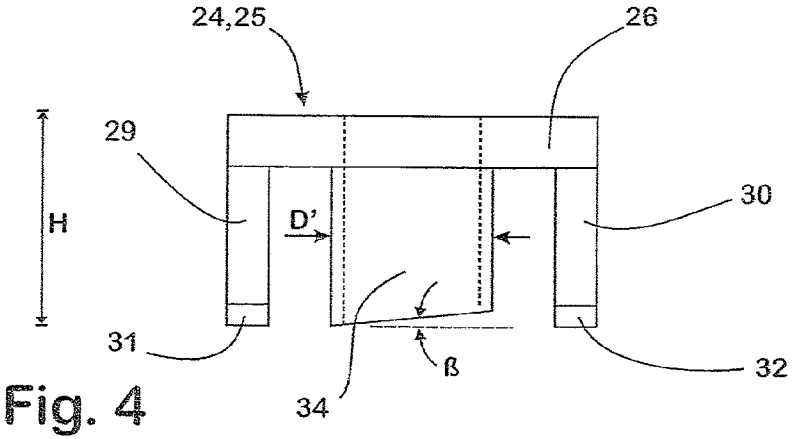
FIG. 4 an adapter piece forming part of a fastening means in a first side view from the direction A' marked in FIG. 3.
Figure 3:
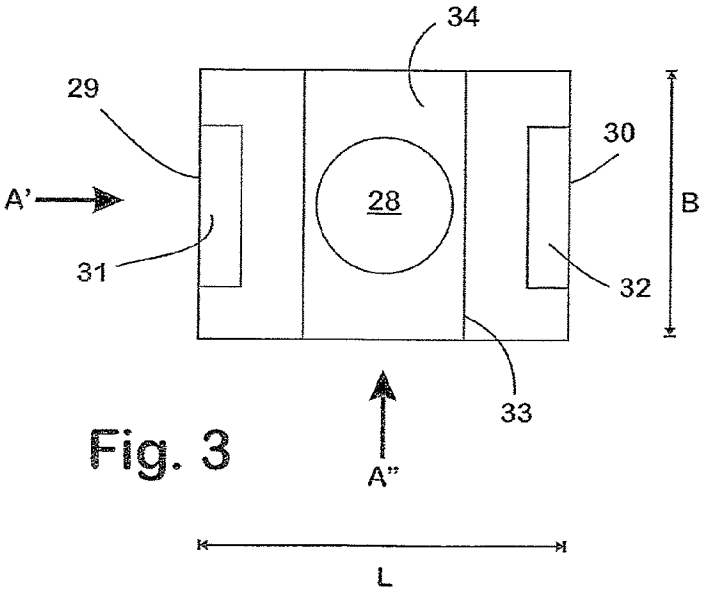
FIG. 3 the adapter piece in a view from below.
Figure 5:
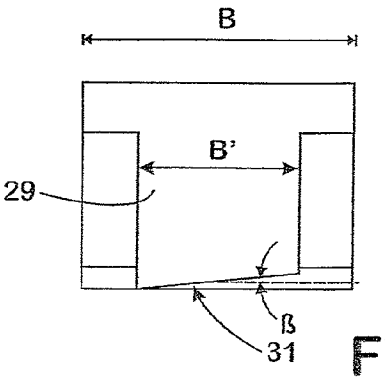
FIG. 5 the adapter piece in a second side view from the direction A" marked in FIG. 3.

The longitudinal axes L3, L4 of the fastening sections 3, 4 are aligned flush in relation to one another in the embodiment, illustrated here only by way of example, so that the sling element 1 seen in top view (FIG. 2) has an elongated shape.

However, the fastening sections 3, 4 could equally also seen in top view be aligned angled to the sling section 2, so that their longitudinal axes L3, L4 intersect at an acute angle. Such an arrangement can, for example, then be appropriate if the respective sling element is to be fastened to a circular flange with a comparably small diameter. The fastening sections could also be curved in a bow-shape if this is suited to the respective mounting situation.

An oblong opening 7, 8 formed as an elongated hole with parallel running longitudinal edges 5, 6 is formed into each of the fastening sections 3, 4, the longitudinal axis of the oblong opening 7, 8 coinciding with the longitudinal axis L3, L4 of the fastening sections.

Additionally, in each case pairs 10, 11 and 12, 13 of wedge areas 14*a*, 14*b*; 15*a*, 15*b*; 16*a*, 16*b*; 17*a*, 17*b* are formed starting from the upper side 9 of the fastening sections 3, 4. The wedge areas 14*a*, 14*b*; 15*a*, 15*b*; 16*a*, 16*b*; 17*a*, 17*b*, each of them parallel running to the longitudinal axis L3, L4 of the fastening sections in top view, of each wedge area pair 10, 11; 12, 13 are aligned inclined in opposite directions to one another and in each case are arranged in each case of a plane E1, E2, E3, E4 which intersects the longitudinal axis L3, L4 of the respective fastening section 3, 4 at an angle β. In this way, the wedge areas 14*a*, 15*a* and 16*a*, 17*a*, adjoining to each case on the longitudinal edges 5, 6 of the respective opening 7, 8, rise in the direction of the end 7*a*, 8*a* of the respective opening 7, 8, assigned to the sling section 2 in each case, while the wedge areas 14*b*, 15*b* and 16*b*, 17*b*, in each case arranged spaced apart from the respective longitudinal edge 5, 6, fall in this direction.

In the exemplary embodiment shown in the figures, the flat contact areas 18, 19 present on the underside of the fastening sections 3, 4 are aligned parallel to the longitudinal axes L3, L4, so that the planes E1, E2, E3, E4 also intersect the notional extensions of the contact areas 18, 19 in each case at an angle β.

Fastening means 20, 21 are provided for bracing the sling element 1 on a flange which is not shown here. The fastening means 20, 21 in each case comprise a conventional screw 22, 23 and an adapter 24, 25.

The identically shaped adapters 24, 25 in top view (FIG. 2) have a rectangular shape, the length L of which except for a slight undersize corresponds to the distance between the outer edges of the wedge areas 14*b*, 15*b* and 16*b*, 17*b* turned away from the respective opening 7 and 8. The undersize is dimensioned in such a way that the adapter pieces 24, 25 with a length L aligned transverse to the longitudinal axis L3, L4 can be easily moved through the recess of the fastening sections 3, 4 occupied by the respective wedge area pairs 10, 11 and 12, 13.

In a corresponding way, the breadth B of the adapters 24, 25 except for a slight undersize corresponds to the distance between the edges, in each case assigned to the outer wedge areas 14*b*, 15*b* and 16*b*, 17*b*, of the inner wedge areas 14*a*, 15*a* and 16*a*, 17*a* adjoining to the respective opening 7, 8. In this case, the undersize is dimensioned in such a way that the adapters 24, 25, with a breadth B aligned transverse to the longitudinal axis L3, L4, can be easily moved through the space laterally bounded by the outer wedge areas 14*b*, 15*b* and 16*b*, 17*b*.

The adapters 24, 25 in each case have a central section 26, on the upper side of which there is a flat bearing area 27 for supporting the head of the respective screw 22, 23. In addition, a centrally arranged through-opening 28 is formed into the central section 26, through which the shaft of the respective screw 22, 23 is guided, in order to insert it through the respectively assigned opening 7,8 of the fastening sections 3, 4.

Two shoulders 29, 30 are integrally formed on the underside of the adapters 24, 25 opposite the bearing area 27, these shoulders 29, 30 in each case adjoining to narrow sides of the respective adapter 24, 25 and being centrally arranged in relation to its breadth B. The breadth B' of the shoulders 29, 30 except for a slight undersize thereby corresponds to the clear width W of the openings 7, 8 measured transverse to the longitudinal axis L3, L4, so that the shoulders 29, 30, when they are aligned transverse to the longitudinal axis L3, L4, can be pushed through the openings 7, 8 with easy clearance.

On the free undersides of the shoulders 29, 30, a wedge area 31, 32 is in each case formed inclined in the direction of the breadth B, the notional extension of which also encloses the angle β with the flat bearing area 27 of the adapters 24, 25.

At the same time, the thickness D of the shoulders 29, 30, measured in the longitudinal direction of the adapters 24, 25, is dimensioned in such a way that the clear width between the shoulders 29, 30 is greater by a slight oversize than the distance between the edges, assigned in each case to the outer wedge areas 14*b*, 15*b* and 16*b*, 17*b*, of the inner wedge areas 14*a*, 15*a* and 16*a*, 17*a* adjoining to the respective opening 7, 8.

Moreover, the height H of the shoulders 29, 30 is chosen, so that when reaching the end of the outer wedge areas 14*b*, 15*b* and 16*b*, 17*b* turned away from the sling section 2 a sufficient distance for the free movement of the adapters 24, 25 also exists there between the underside of the central section 26 and the inner wedge areas 14*a*, 15*a* and 16*a*, 17*a* reaching their highest point there in relation to the outer wedge areas 14*b*, 15*b* and 16*b*, 17*b*. In this way, the adapters 24, 25 with a length L aligned transverse to the longitudinal axis L3, L4 can be placed with their shoulders 29, 30 onto the outer wedge areas 14*b*, 15*b* and 16*b*, 17*b* of the fastening sections 3, 4 in each case and moved on them, so that the bearing area 27 is guided essentially parallel to the respective contact area 18, 19.

In addition, a shoulder 33 is formed on the underside of the adapters 24, 25, which is centrally arranged in relation to the length L of the adapters 24, 25 and extends across the breadth B of the adapters 24, 25. Its thickness D' measured in the longitudinal direction likewise except for a slight undersize corresponds to the clear width W, measured transverse to the longitudinal axis L3, L4, of the openings 7, 8, so that the shoulders 29, 30, when they are aligned transverse to the longitudinal axis L3, L4, can be pushed through the openings 7, 8 with easy clearance.

On the free underside of the central shoulder 33, a wedge area 34 is formed, extending across the entire breadth B and inclined in the direction of the length L, the notional extension of which also intersects the bearing area 26 at an angle β. In this way, the adapters 24, 25 with a breadth B aligned transverse to the longitudinal axis L3, L4 can be placed with their shoulder 33 onto the inner wedge areas 14*a*, 15*a* and 16*a*, 17*a* of the fastening sections 3, 4 in each case and moved on them, so that the bearing area 27 is guided essentially parallel to the respective contact area 18, 19.

Figure 1:
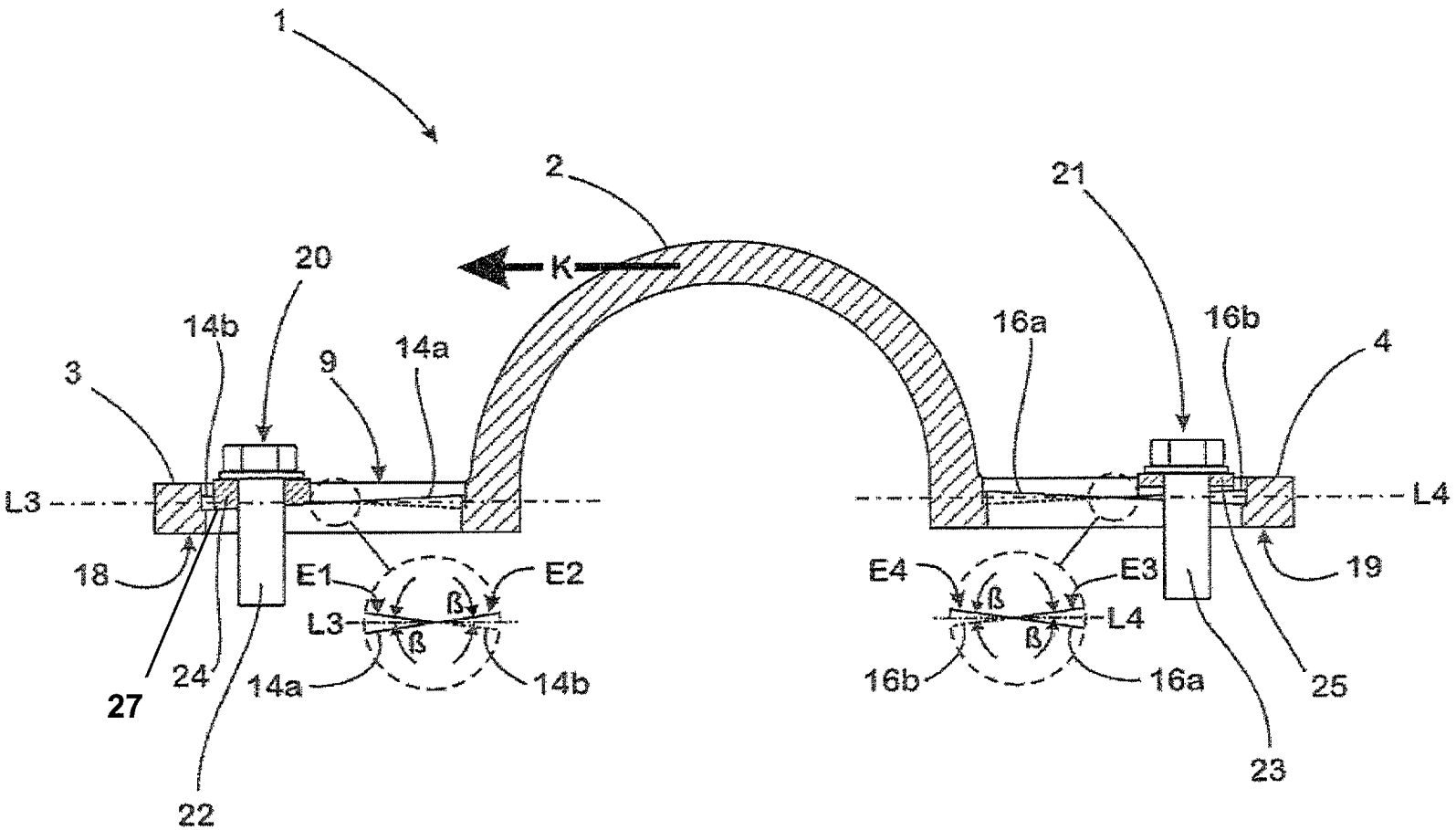
FIG. 1 a sling element in a longitudinal section.

When mounting the sling element 1 on a flange (not shown here), the adapters 24, 25 are in each case aligned so that they are in each case supported on those wedge areas 14*a*-17*b* which rise against the force K which under load would result in the sling element 1 moving relative to the goods item to be lifted. If the respective force K, as indicated in FIG. 1, is directed in the direction of the one fastening section 3, then the adapter 24 assigned to this fastening section 3 is consequently supported on the inner wedge areas 14*a*, 15*a* rising in the direction of the sling section 2, while the adapter 25 assigned to the other fastening section 4 sits on the outer wedge areas 16*b*, 17*b* rising in the direction turned away from the sling section 2. In this way, the adapter element 1 is wedged against the screws 22, 23 of the fastening means 20 and 21, so that each unwanted slip of the sling element 1 can be reliably prevented even under heavy load.

REFERENCE SYMBOLS

1 Sling element
2 Sling section

3, 4 Fastening sections
5, 6 Longitudinal edges of the openings 7, 8
7, 8 Oblong openings
9 Upper side of the fastening sections 3, 4
10-13 Pairs of wedge areas 14*a*-17*b*
14*a*, 14*b* Wedge areas of the wedge area pair 10
15*a*, 15*b* Wedge areas of the wedge area pair 11
16*a*, 16*b* Wedge areas of the wedge area pair 12
17*a*, 17*b* Wedge areas of the wedge area pair 13
18, 19 Contact areas of the fastening sections 3, 4
20, 21 Fastening means
22, 23 Screws of the fastening means 20, 21
24, 25 Adapters of the fastening means 20, 21
26 Central section of the adapters 24, 25
27 Bearing area of the adapters 24, 25
28 Through-opening
29, 30 Lateral shoulders of the adapters 24, 25
31, 32 Wedge areas of the shoulders 29, 30
33 Central shoulder of the adapters 24, 25
34 Wedge area of the central shoulder 33
β Angle
B Breadth of the adapters 24, 25
B' Breadth of the shoulders 29, 30
D' Thickness of the central shoulder 32
E1-E4 Planes of the wedge areas 14*a*-17*b*
H Height of the shoulders 29, 30
K Force
L Length of the adapters 24, 25
L3, L4 Longitudinal axes of the fastening sections 3, 4
W Clear width of the openings 7, 8

The invention claimed is:

1. A sling element for coupling sling gear, including a shackle, hook or ring, or a lifting means, including a belt, a rope, a chain or a strap, to a goods item to be transported, comprising a fastening section, into which an oblong-shaped opening is formed which leads from an upper side of the fastening section to a contact area formed on an underside of the fastening section, wherein a wedge area aligned in a longitudinal direction of the opening of the fastening section is formed on the fastening section, which entire wedge area runs in a plane which intersects a longitudinal axis of the opening at an acute angle and is designed as a support for a fastening means which extends substantially perpendicular relative to the longitudinal axis of the opening to brace the sling element on the goods item to be transported.

2. The sling element according to claim 1, wherein a wedge area in each case extends with the same angular alignment with respect to the longitudinal axis of the oblong opening of the fastening section along both longitudinal sides of the opening.

3. The sling element according to claim 1, wherein the respective wedge area adjoins to the oblong opening of the fastening section.

4. The sling element according to claim 1, wherein at least one pair of wedge areas is present, of which the plane of the one wedge area is aligned running in the opposite direction to the plane of the other wedge area at an acute angle related to the longitudinal axis of the opening.

5. The sling element according to claim 4, wherein in each case a pair of wedge areas aligned running in opposite directions extends along each of the longitudinal sides of the opening.

6. The sling element according to claim 5, wherein the wedge areas assigned to the respective longitudinal edge of the opening of the fastening section run inclined in the same direction.

7. A combination comprising a sling element designed according to claim 6 and a fastening means for bracing the sling element on a goods item to be transported, wherein the fastening means comprises a separately prefabricated adaptor piece with a wedge area with which the fastening means is movably supported on a wedge area of the fastening section of the sling element and a tensioning element, and wherein the adapter piece has a contact area on its upper side turned away from the wedge area of the fastening section for supporting the tensioning element, as well as a through-opening for guiding the tensioning element through.

8. The combination according to claim 7, wherein the adapter piece has at least two projecting parts, on which a wedge area is formed which corresponds to one of the wedge areas of the fastening section inclined in the same direction.

9. The combination according to claim 7, wherein the adapter piece has a pair of wedge areas, which are arranged correspondingly distantly from the longitudinal sides of the opening of the assigned fastening section, and a pair of wedge areas, arranged between the first pair, which are arranged adjacent to the longitudinal edges of the opening of the fastening section and transverse to the wedge areas of the first pair of wedge areas.

10. The combination according to claim 9, wherein the length of the second pair of wedge areas is dimensioned in such a way that the wedge areas of this pair with an alignment transverse to the longitudinal axis of the opening of the fastening section can be moved with clearance through the opening along its longitudinal axis.

11. The sling element according to claim 5, wherein the wedge areas assigned to the respective longitudinal edge run inclined in the opposite direction.

12. The sling element according to claim 4, wherein the planes of the wedge areas of the respective pair of wedge areas intersect the longitudinal axis of the opening at the same angle.

13. The sling element according to claim 1, wherein the opening of the fastening section is formed as an elongated hole with longitudinal sides running parallel to one another.

14. The sling element according to claim 1, wherein it is designed in the style of a sling bow with a U-shaped sling section, on the ends of which in each case a fastening section is integrally formed.

15. A combination comprising a sling element, designed according to claim 1, and a fastening means for bracing the sling element on a goods item to be transported, wherein the fastening means comprises a shaped element with a wedge area with which the fastening means is movably supported on a wedge area of the fastening section of the sling element.

16. The combination according to claim 15, wherein the fastening means comprises a tensioning element, and a shoulder formed on the tensioning element as a shaped element, the wedge area of the fastening section being formed on the shoulder.

17. The combination according to claim 15, wherein the fastening means has a tensioning element, and a separately prefabricated adapter piece as the shaped element, the adapter piece having a contact area on its upper side turned away from the wedge area of the fastening section for supporting the tensioning element, as well as a through-opening for guiding the tensioning element through.

* * * * *